US005745959A

United States Patent [19]

Dodge

[11] Patent Number: 5,745,959

[45] Date of Patent: May 5, 1998

[54] RATCHET-TYPE BUCKLE

[75] Inventor: David J. Dodge, Williston, Vt.

[73] Assignee: The Burton Corporation, Burlington, Vt.

[21] Appl. No.: 779,526

[22] Filed: Jan. 7, 1997

[51] Int. Cl.[6] ..... A43C 11/00; A44B 21/00

[52] U.S. Cl. ..... 24/68 SK; 24/70 SK; 24/71 SK

[58] Field of Search ..... 24/68 SK, 69 SK, 24/70 SK, 71 SK

[56] References Cited

U.S. PATENT DOCUMENTS

| | | | |
|---|---|---|---|
| 357,287 | 2/1887 | Nolte . | |
| 376,055 | 1/1888 | Hopkins et al. . | |
| 2,271,452 | 1/1942 | Carroll . | |
| 3,258,820 | 7/1966 | Steinberg | 24/70 |
| 3,292,222 | 12/1966 | Steinberg | 24/68 |
| 3,662,435 | 5/1972 | Allsop | 24/70 SK |
| 3,668,791 | 6/1972 | Salzman et al. | 36/50 |
| 4,112,557 | 9/1978 | Salomon | 24/69 SK |
| 4,193,171 | 3/1980 | Lichowsky | 24/68 SK |
| 4,310,951 | 1/1982 | Riedel | 24/68 SK |
| 4,326,320 | 4/1982 | Riedel | 24/70 SK |
| 4,424,636 | 1/1984 | Everest | 36/50 |
| 4,453,290 | 6/1984 | Riedel | 24/70 SK |
| 4,547,980 | 10/1985 | Olivieri | 24/70 SK |
| 4,553,292 | 11/1985 | Pradier et al. | 24/68 SK |
| 4,555,830 | 12/1985 | Petrini et al. | 24/68 SK |
| 4,596,080 | 6/1986 | Benoit et al. | 36/120 |
| 4,614,047 | 9/1986 | Arieh et al. | 36/50 |
| 4,624,063 | 11/1986 | Delery | 36/117 |
| 4,646,401 | 3/1987 | Morell | 24/68 SK |
| 4,670,946 | 6/1987 | Olivieri | 24/71 SK |
| 4,683,620 | 8/1987 | Valsecchi et al. | 24/68 SK |
| 4,759,137 | 7/1988 | Lederer | 36/117 |
| 4,761,859 | 8/1988 | Calabrigo | 24/70 SK |
| 4,761,898 | 8/1988 | Courvoisier et al. | 36/50 |
| 4,796,337 | 1/1989 | Marxer | 24/68 SK |
| 5,003,711 | 4/1991 | Nerinck et al. | 36/120 |
| 5,083,350 | 1/1992 | Sandreid | 24/134 R |
| 5,172,454 | 12/1992 | Martiganago | 24/68 SK |
| 5,357,690 | 10/1994 | Ho | 36/50.1 |
| 5,416,952 | 5/1995 | Dodge | 24/68 SK |
| 5,426,826 | 6/1995 | Takimoto | 24/68 CD |
| 5,526,555 | 6/1996 | Battistella et al. | 24/68 SK |

FOREIGN PATENT DOCUMENTS

| | | |
|---|---|---|
| 324170 B | 10/1974 | Austria . |
| 0 572 373 A1 | 12/1993 | European Pat. Off. . |
| 1340134 | 9/1963 | France . |

OTHER PUBLICATIONS

Japanese Utility Model Application No. 51–163595 (Laying Open No. 52–78549), Allsop, 1977.

Japanese Utility Model Application No. 57–200539 (Laying Open No. 59–101808), Matsumoto, Jul. 1984.

Japanese Patent Laying–Open No. 60–234680 Valsecchi, Nov. 21, 1985.

Japanese Patent Laying Open No. 57–93001, Riedel, Jun. 9, 1982.

*Primary Examiner*—Victor N. Sakran

*Attorney, Agent, or Firm*—Wolf, Greenfield & Sacks, P.C.

[57] ABSTRACT

A ratchet buckle for incrementally tightening and quickly releasing a strap, such as a snowboard binding strap and the like. A housing supports a pawl, a release actuator and a drive actuator. The housing slidably receives a serrated strap, which is engaged by the pawl to prevent an inadvertent release from the buckle. The drive actuator allows a user to selectively tighten the strap relative to the buckle. The release actuator is arranged to both disengage the pawl from the strap and separate the buckle from the strap using one continuous motion. The pawl, release actuator and drive actuator may be pivotally mounted to the housing about separate axes, and the drive actuator may be pivotally attached to the release actuator.

28 Claims, 8 Drawing Sheets

RATCHET-TYPE BUCKLE

BACKGROUND OF THE INVENTION

1. Field of the Invention

The present invention relates generally to a ratchet-type buckle. More particularly, the present invention relates to a ratchet-type buckle that may be used on a soft boot snowboard binding strap.

2. Description of Related Art

Binding systems for soft snowboard boots typically include one or more straps for securing the boot to the snowboard. In a front entry binding system, each strap includes two strap portions that are separated from each other to provide an opening for the rider to place his or her foot into the binding. The strap portions are then rejoined and tightened around the seated boot to securely hold the boot on the snowboard. The ease in which a binding strap may be released and then secured is important in snowboarding where the user must remove the rear boot from its binding prior to ascending the mountain on the chairlift and then, upon exiting the chairlift, must reattach the rear boot and binding prior to the next ride down the trail. Consequently, a day of riding may involve numerous occurrences of releasing and securing the rear boot binding straps.

Ratchet-type buckles are known for securing and releasing snowboard binding straps. Applicant's U.S. Pat. No. 5,416,952 describes a Slap Ratchet™ buckle used in soft boot snowboard bindings from Burton. The Slap Ratchet buckle permits easy incremental tightening of the binding straps as well as quick release of the buckle and straps. The Slap Ratchet buckle, which is attached to one of the strap portions, includes a pawl which locks the serrated surface of the other strap portion. To release the binding, a tab is pushed in one direction, which disengages the pawl from the strap teeth, and then the buckle is drawn away in the opposite direction while the user continues to push the tab until the strap portions are separated.

SUMMARY

The present invention is a ratchet-type buckle in which a continuously directed movement of a release actuator conveniently disengages the pawl from the strap teeth while also separating the buckle and the serrated strap. The release actuator may be arranged in the buckle so that movement of the release actuator upwardly and away from the serrated strap, such as by pivoting, disengages the pawl from the strap and moves the buckle along the serrated strap to release the buckle from the serrated strap.

In an illustrative embodiment, a ratchet buckle includes a housing that is adapted to slidably receive a strap. A pawl is supported by the housing to engage and prevent inadvertent release of the strap. A drive actuator is supported by the housing to feed the strap through the housing, incrementally tightening the strap. A release actuator is supported by the housing to disengage the pawl from the strap and to withdraw the strap from the housing so that the strap can be released from the housing using one continuous motion. The buckle may also include a stop to limit movement of the release actuator.

In another embodiment, a ratchet buckle for adjusting a strap includes a housing that is adapted to slidably receive the strap, a pawl, a drive actuator and a release actuator. The pawl is pivotally mounted to the housing about a first axis to engage and prevent an inadvertent release of the strap. The drive actuator is pivotally mounted to the housing about a second axis and a third axis to engage and feed the strap through the housing to incrementally tighten the strap. The release actuator is supported by the housing to disengage the pawl from the strap so that the strap can be released from the housing.

In a further embodiment, the ratchet buckle of the present invention is employed in a snowboard binding. The binding includes a base plate and one or more adjustable binding straps, each including a pair of strap portions, which may be tightened across various portions of a snowboard boot seated in the binding. The buckle is attached to one strap portion and the other strap portion is received by the buckle to tighten the binding strap.

BRIEF DESCRIPTION OF THE DRAWINGS

It should be understood that the drawings are provided for the purpose of illustration only and are not intended to define the limits of the invention. The foregoing and other objects and advantages of the present invention will become apparent with reference to the following detailed description taken in conjunction with the accompanying drawings in which.

DETAILED DESCRIPTION OF THE PREFERRED EMBODIMENTS

Figure 1:
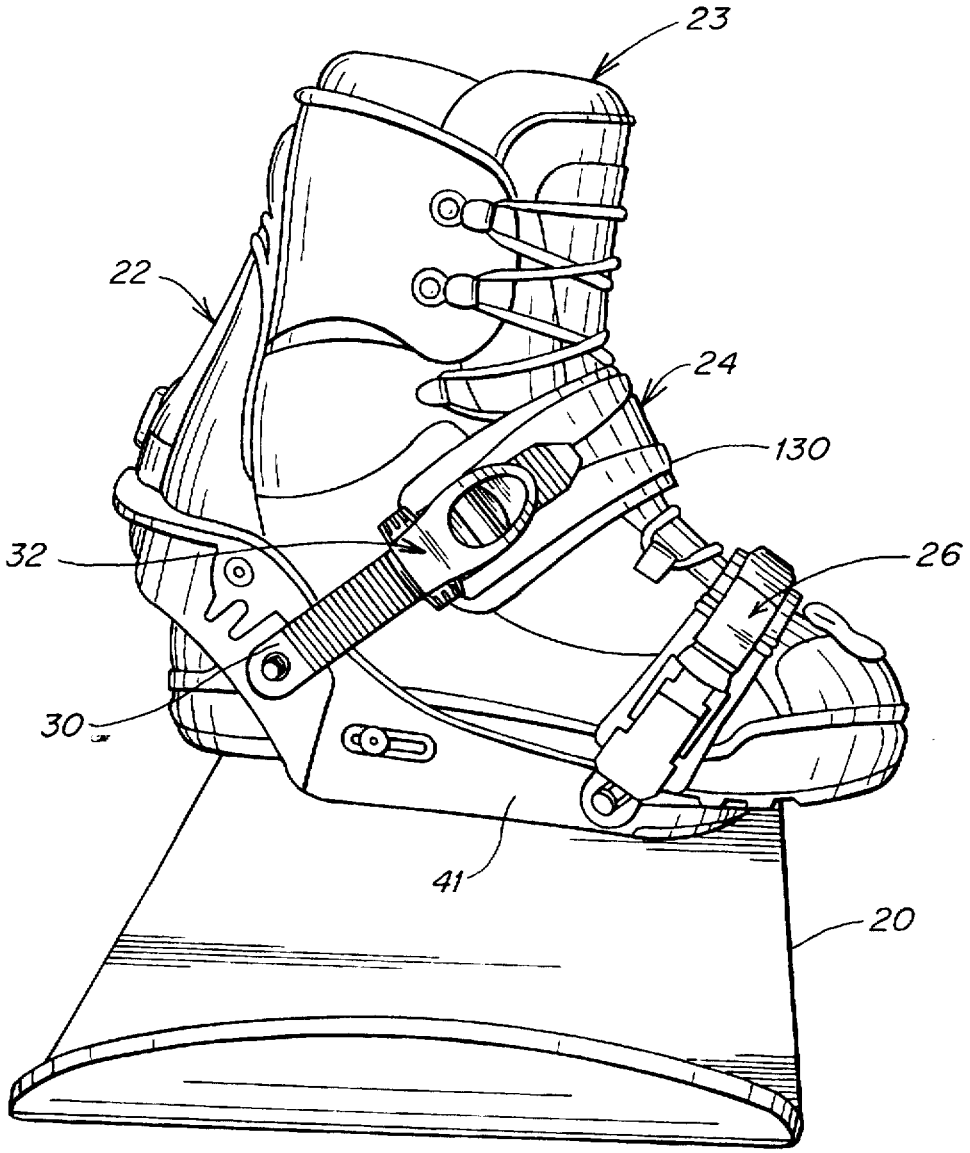
FIG. 1 is a front view of a snowboard that includes a snowboard binding mounted on a snowboard and which has a ratchet-type buckle arrangement according to the present invention.
Figure 2:
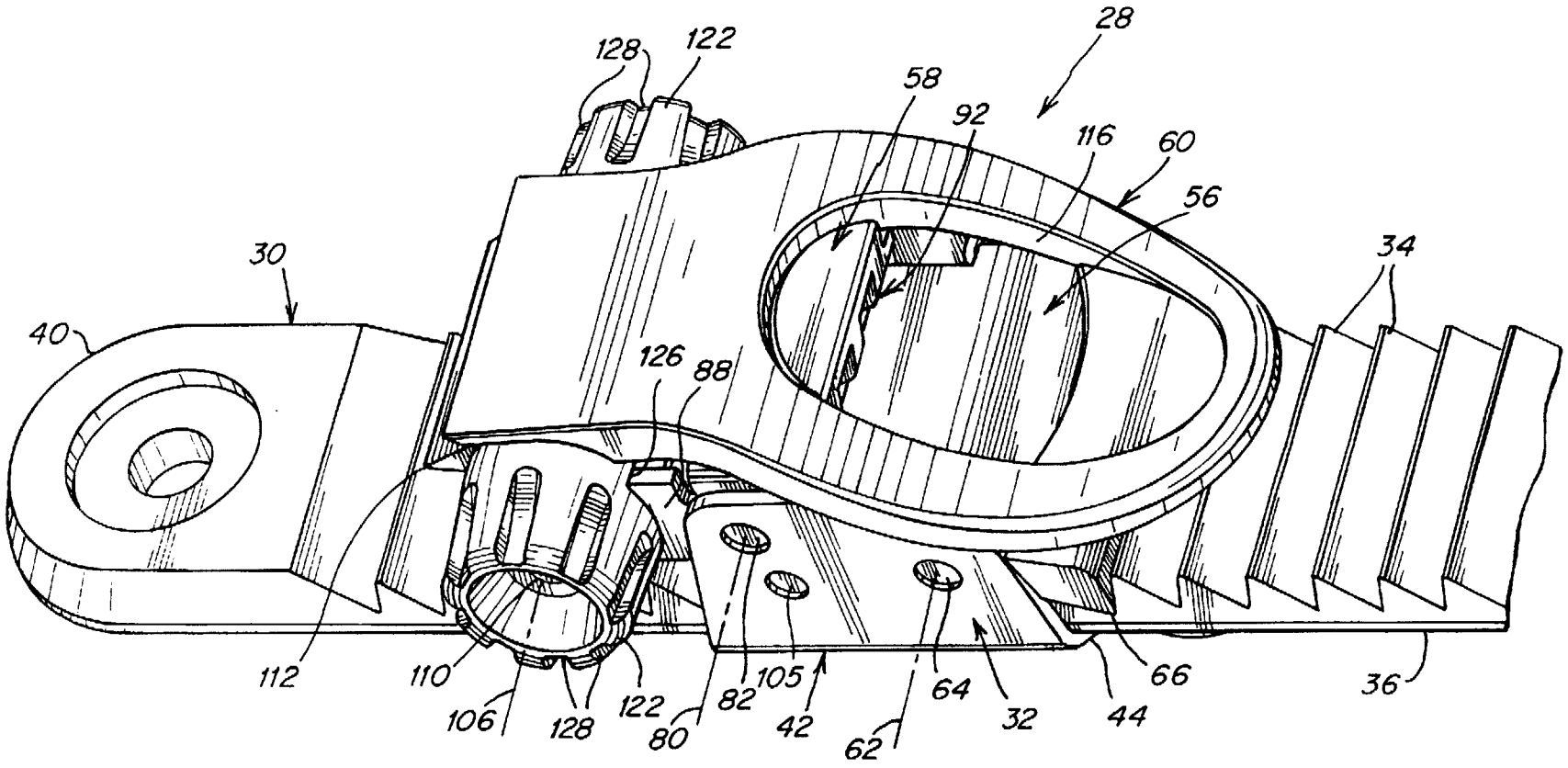
FIG. 2 is a perspective view of an illustrative embodiment of the ratchet-type buckle arrangement of the present invention.

A soft boot snowboard binding 22 is attached to a snowboard 20, as illustrated in FIG. 1, with a soft snowboard boot 23 secured in the binding 22. The binding 22 includes at least one adjustable strap, and typically two or three, which may be tightened across various portions of the boot. For example, the adjustable straps may include an ankle strap 24 and a toe strap 26 as shown in FIG. 1, and may further include a shin strap (not shown). The straps can be incrementally tightened and conveniently released using a ratchet-type buckle 32 in accordance with the present invention. Although a leverage toe-clip is illustrated, the ratchet buckle 32 according to the present invention may also be used to release and secure the toe strap.

One illustrative embodiment of the ratchet-type buckle arrangement 28, as shown in FIGS. 2–5, includes a strap 30 and a ratchet buckle 32 that is adapted to slidably receive and secure the strap 30. The strap 30 may be one portion of an adjustable strap such as the ankle strap 24 shown in FIG. 1. The strap 30 may include a rack of teeth or serrations 34 disposed on its upper surface with a bottom surface 36 that is relatively smooth to slide easily through the buckle 32. One end of the strap may include a rounded or tapered tip 38 that is easily inserted into the buckle 32 and an opposite end 40 that may be mounted to the binding baseplate 41 (FIG. 1) using a fastener, such as a screw, rivet or the like, as is known in the art.

The ratchet buckle 32 comprises a housing 42 for receiving the strap 30 and which may include a base 44 and a pair of side members 46, 48. The strap 30 is inserted into a front portion 52 of the housing 42 and exits through a rear portion 54 of the housing. A pawl 56 and a release actuator 58 are arranged in the housing 42 in a manner, as described below, that allows the user to easily loosen or completely release the strap 30 using a commonly directed actuation motion. A drive actuator 60 may also be supported on the housing to allow the user to incrementally drive the strap 30 through the buckle 32 to selectively tighten the adjustable strap 24. The housing 42 may be formed from a tough, impact resistant and durable material, such as sheet steel or plastic.

Figure 3:
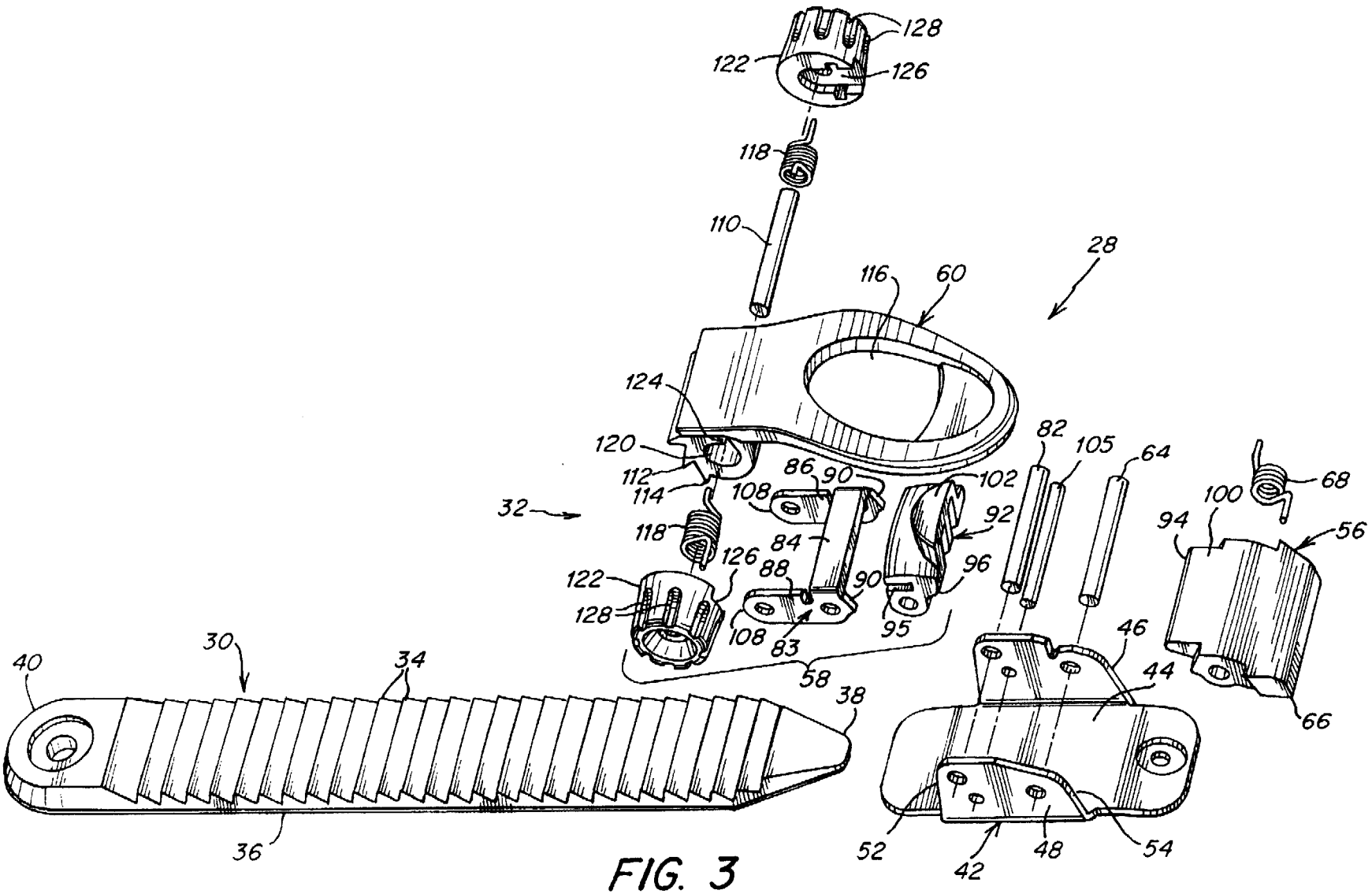
FIG. 3 is an exploded perspective view of the ratchet-type buckle arrangement of FIG. 2.
Figure 5:
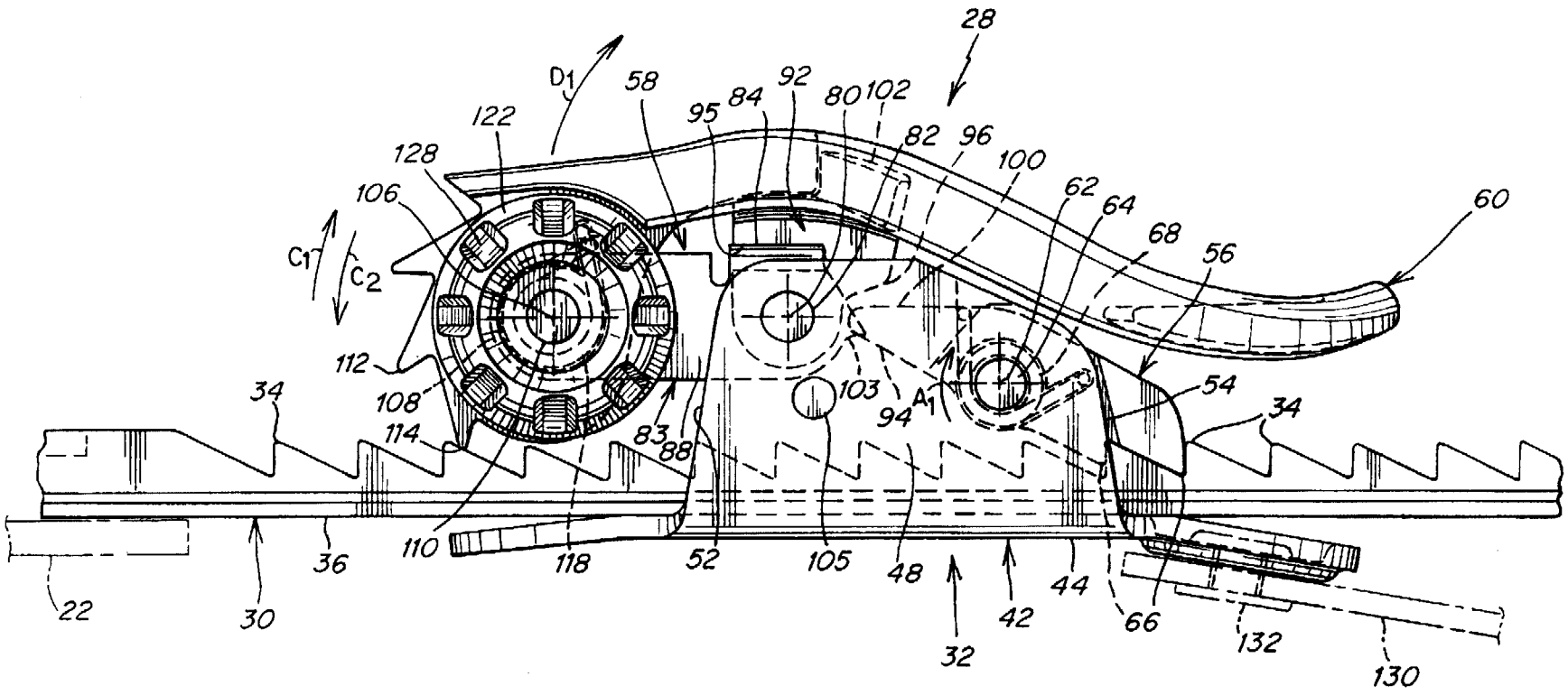
FIG. 5 is a side elevational view of the ratchet-type buckle arrangement of FIGS. 2–4 in the latched position.

The pawl 56 is arranged to engage and retain the strap 30 so that the strap cannot be released until the user disengages the pawl from the strap. In one embodiment as shown in FIGS.3 and 5, the pawl 56 may be pivotally mounted to the housing 42 about a first axis 62 by a first pin 64, although other means of attachment known in the art may be used. The pawl 56 may include one or more pawl teeth 66 that are configured to coact with the strap teeth 34 so that the strap 30 can be tightened in one direction and cannot be loosened or released in the opposite direction until the pawl 56 is intentionally released from the strap by the user. The pawl may be formed from a plastic material, although other materials known in the art may be used, such as metal.

As shown in FIG. 5, the pawl 56 is biased in a first direction $A_1$ (clockwise in FIG. 5) and into engagement with the strap 30 to ensure that the pawl does not inadvertently disengage from the strap. In one embodiment, a torsion spring 68 may be disposed about one end of the first pin and preloaded with a torque that is sufficient to maintain the pawl 56 securely against the strap 30. As the strap 30 is fed through the buckle and tightened, the pawl 56 pivots in a reciprocating manner so that it intermittently engages and disengages the strap teeth 34. It is to be appreciated that other means known in the art may be used to bias the pawl.

The release actuator 58 quickly and easily releases the buckle 32 from the strap 30 using a one-step operation that disengages the pawl 56 from the strap 30 and also pulls and releases the buckle from the strap. This provides the user with a convenient and easily operated release mechanism that is particularly suitable for use in a snowboard binding in which the binding straps are frequently released and secured during a day of riding.

In one embodiment as shown in FIGS. 3 and 5, the release actuator 58 may be pivotally mounted to the housing 42 about a second axis 80 by a second pin 82, although other means of attachment known in the art may be used. The release actuator 58 may include a lever 83 and a release member 92 that includes a portion that overlies a lever portion 94 of the pawl 56. The lever 83 may be comprised of a cross member 84 extending between the side members of the housing 42 and a pair of opposing link arms 86, 88 extending downwardly from opposing sides of the cross member 84. The rear portion 90 of each link arm 86, 88 is pivotally mounted to the housing by the second pin 82 with the cross member 84 overlying the second pin 82. The release member 92 may have a slot 95 that receives the cross member 84 to attach the release member 92 to the lever 83 with a lower portion of the release member 92 being pivotally mounted to the second pin 82. The release member 92 may include a lower cam surface 96, preferably an arcuate surface, which is adapted to engage and coact with the upper surface 100 of the pawl lever 98 to disengage the pawl from the strap. When the release actuator 58 is pivoted in a first direction $B_1$ (clockwise in FIG. 6C), the cam surface 96 interacts with the pawl lever 94 to pivot the pawl 56 about the first axis 62 in the second direction $A_2$, thereby disengaging the pawl teeth 66 from the strap 30. The lever 83 is preferably formed from a metal, such as steel, although other materials may be used which provide strength and rigidity necessary for its proper operation. Although the release member 92 may be integrally formed as part of the lever member 83, the release member is preferably formed as a separate part from a plastic material to provide more flexibility in shaping the cam surface and to reduce the friction between itself and the pawl for easier operation of the release actuator.

The release actuator 58 also includes a member that the user can grasp to easily operate the release actuator, even when the user is wearing a hand covering such as a glove. In one embodiment as shown in the figures, the grasp member may be provided by a cap 122 disposed on the front ends 108 of the link arms 86, 88. The user may hook his or her index and middle fingers around the caps 122 to pull the front end of the lever 83 upwardly and away from the strap 30. This action pivots the release actuator 58 about the second axis 80 and disengages the pawl 56 from the strap 30. Each cap 122 may include one or more axially extending recesses 128 that are radially disposed along the outer wall of the cap to allow the user to more easily grip the caps and pull the release actuator 58.

Figure 6A:
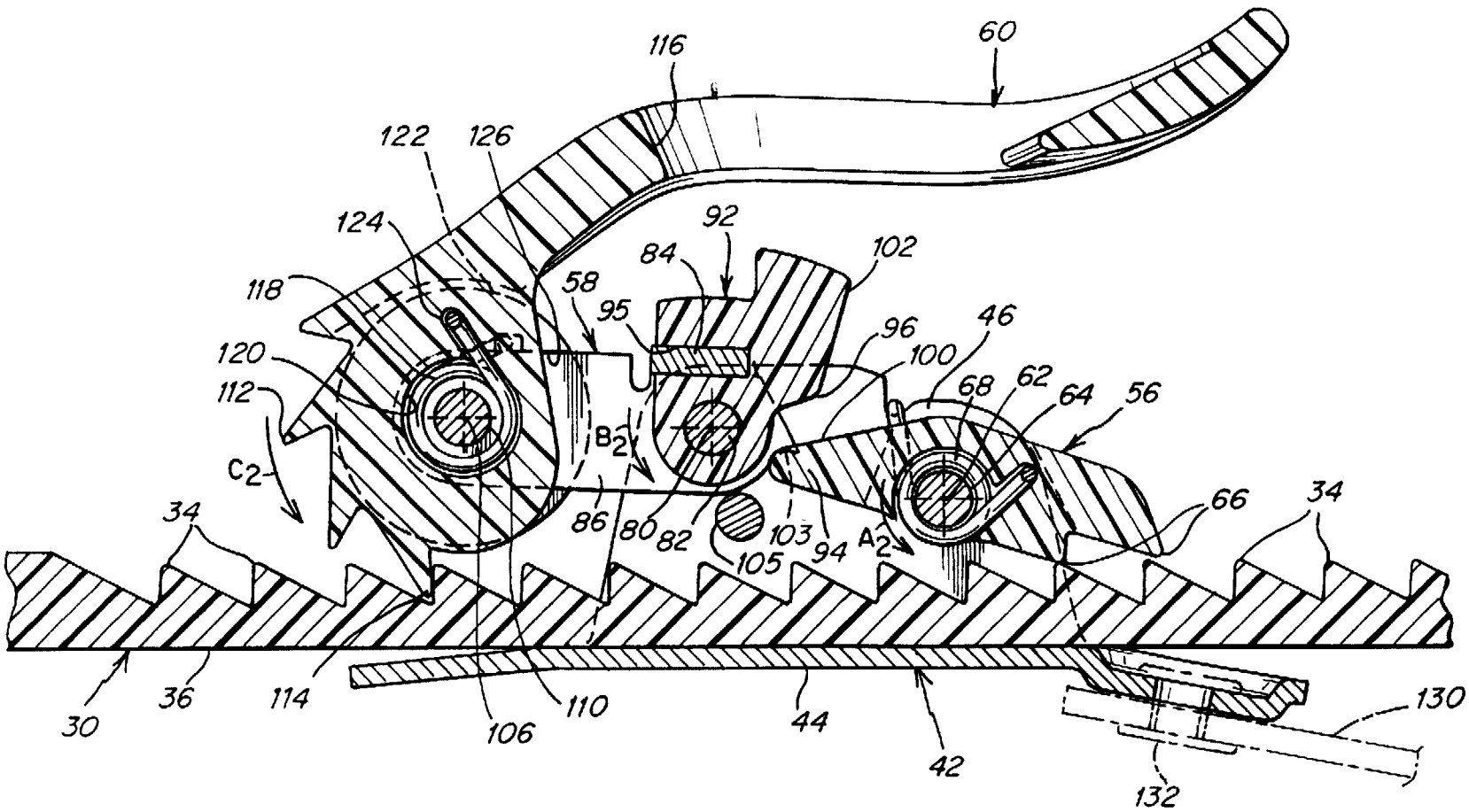
FIG. 6A is a side cross-sectional view of the ratchet-type buckle arrangement taken along section line 6—6 in FIG. 4 illustrating the drive actuator initially positioned to drive the strap.
Figure 6B:
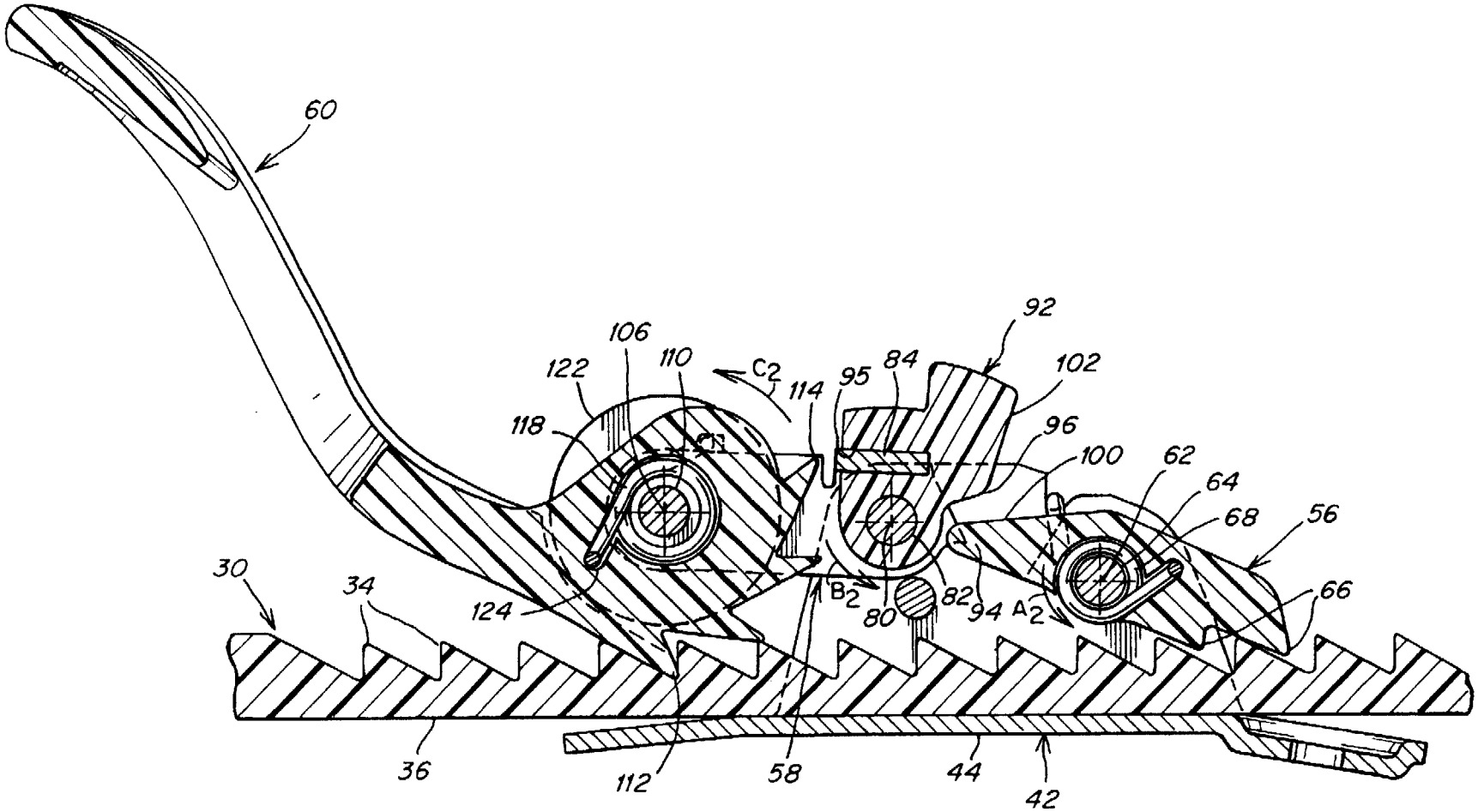
FIG. 6B is a side cross-sectional view of the ratchet-type buckle arrangement taken along section line 6—6 in FIG. 4 illustrating the drive actuator positioned after driving the strap.
Figure 6C:
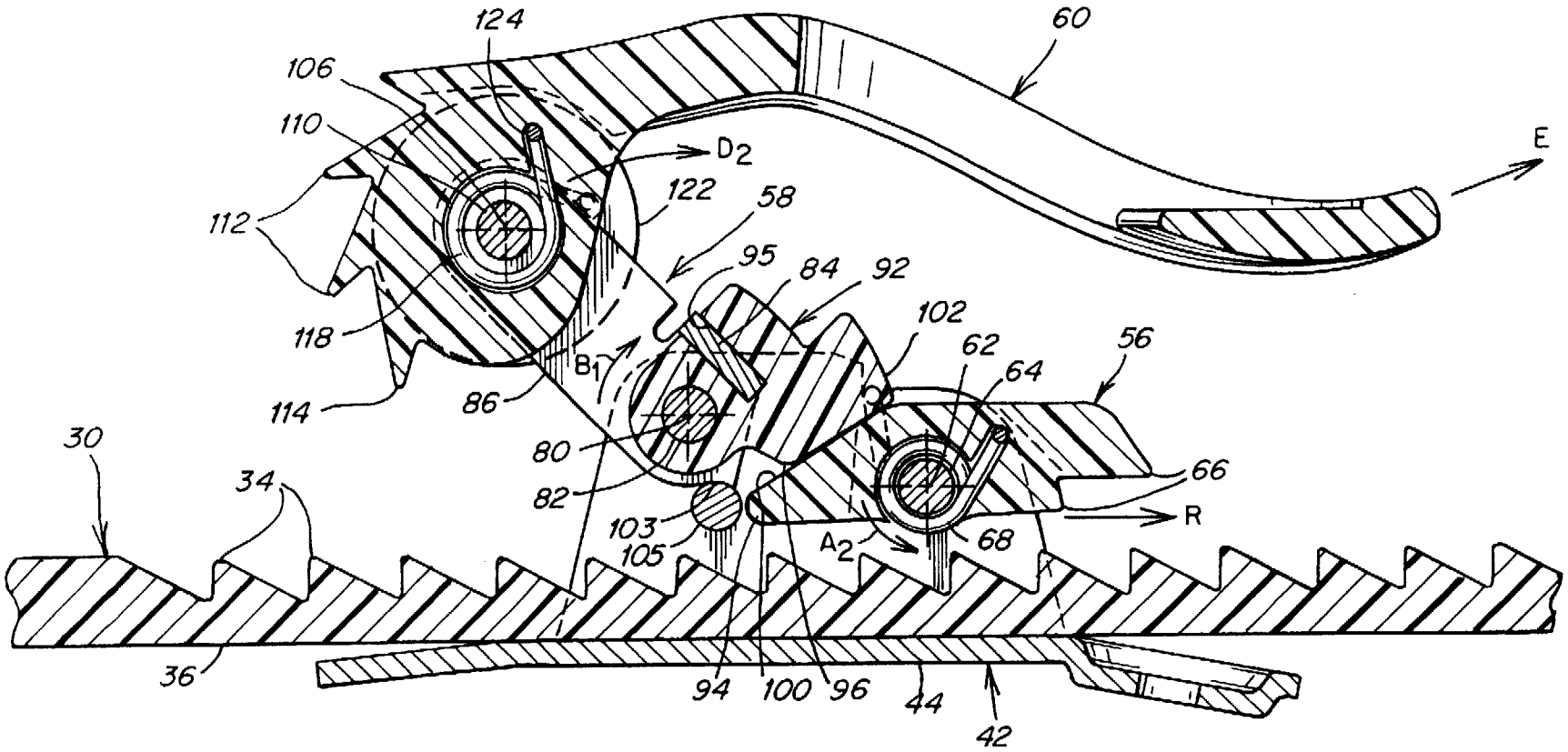
FIG. 6C is a side cross-sectional view of the ratchet-type buckle arrangement taken along section line 6—6 in FIG. 4 illustrating the release actuator and pawl positioned to release the strap.

The ratchet buckle may include a stop to limit the movement of the release actuator 58. The stop ensures that the release actuator 58 cannot be overrotated to a position where it no longer acts on the pawl lever 94 to disengage the pawl from the strap. In one embodiment, the release member 92 may include a stop 102 which abuts the upper surface 100 of the pawl lever 94 as the release actuator 58 disengages the pawl from the strap as shown in FIG. 6C, thereby preventing any additional rotation of the release actuator. In another embodiment as shown in FIG. 5, the rear lower edge of each link (arm 86, 88 may be formed with a recess 103 that is adapted to abut a stop pin 105 thereby restricting the maximum rotation of the release actuator 58. The stop pin 105 may be mounted to the side members 46, 48 of the housing 42 below and between the first and second pins 64, 82.

The one-step actuation of the release actuator 58 to free the strap from the buckle will be described with reference to FIGS. 5 and 6C. The user first disengages the pawl 56 from the strap teeth 34 by grasping the caps 122, preferably by hooking his or her index and middle fingers around the front of the caps, and then pulling in an upward and rearward direction $D_1$ (FIG. 5) away from the strap 30. This action causes the release actuator 58 to pivot in the first direction $B_1$ about the second axis 80 so that the release member 92 engages the pawl lever 94 and pivots the pawl 56 in the second direction $A_2$about the first axis 62. The release actuator 58 is pivoted until the stop 102 engages the pawl lever 94, as shown in FIG. 6C, and the pawl 56 fully disengages the strap teeth 34. With the pawl disengaged, the strap can move through the housing so that it may be loosened or released from the buckle. As shown in FIG. 6C, as the user continues pulling the caps 122 to release the pawl, the caps 122 pivot about the second axis 80 so that they are pulled in a direction $D_2$ toward the rear of the housing. This action pulls the buckle 32 along the strap 30 in a release direction R so that the strap is effectively loosened or completely released from the buckle. Thus, the user may easily and conveniently unbuckle a snowboard binding or other apparatus by pulling the release actuator using one continuous motion for a one-step operation.

The drive actuator 60 is used to incrementally tighten the strap 30 by driving or feeding the strap through the buckle using a relatively small amount of force. In one embodiment as shown in the figures, the front end of the drive actuator 60 may be pivotally connected to the housing 42 about a third axis 106 with the third pin 110 between the front ends 108 of the link arms 86, 88. The drive actuator 60 may include one or more ratchet teeth 112 that engage and coact with the strap teeth 34 in a ratcheting manner to drive and tighten the strap 30 as the actuator 60 is pivoted in the second direction $C_2$ about the third axis. The drive actuator 60 may also pivot about the second axis 80 in a second direction $B_2$ (counterclockwise in FIG. 6A) so that its front end can be pushed downwardly against the strap to ensure that the ratchet teeth 112 properly engage the strap teeth 34 and do not skip or misfire when driving the strap.

Figure 4:
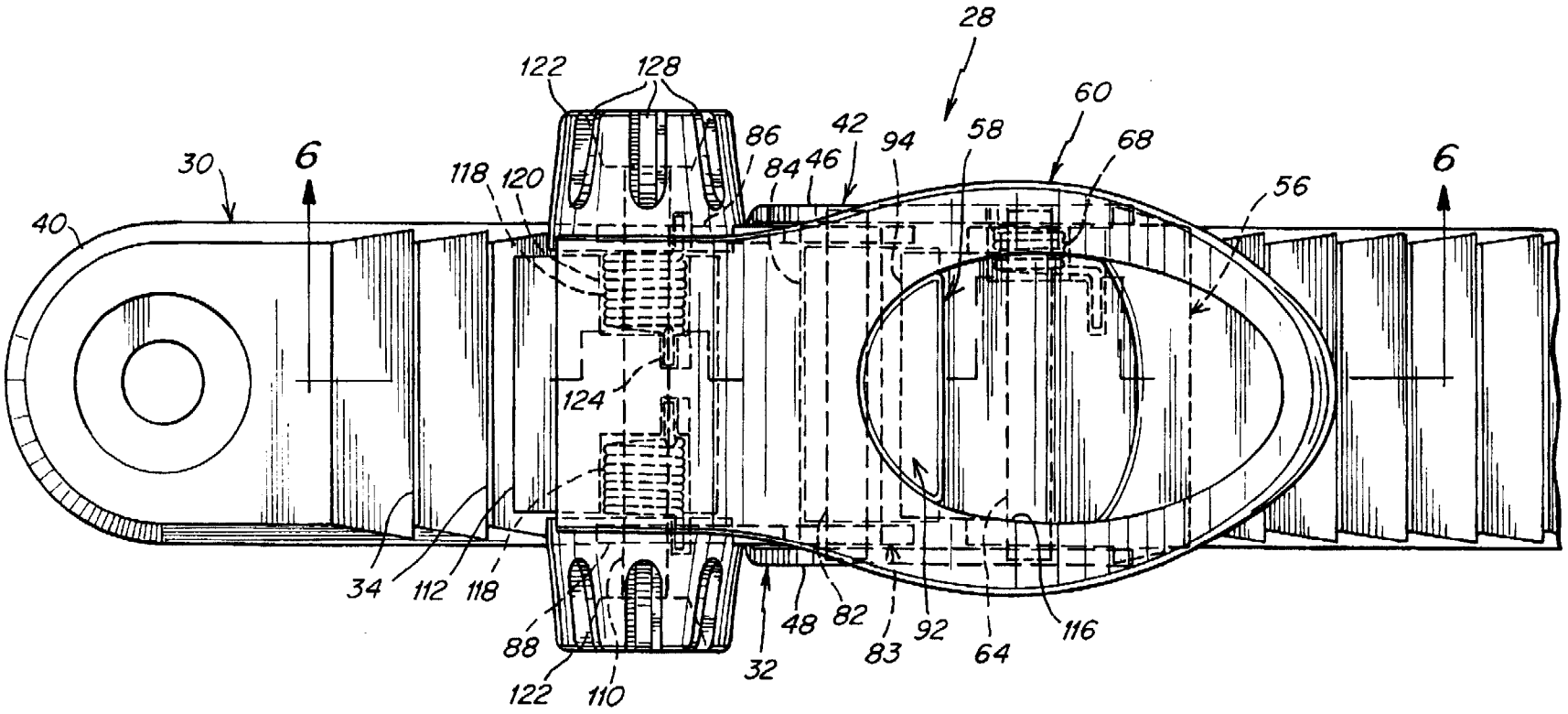
FIG. 4 is a top view of the ratchet-type buckle arrangement of FIGS. 2–3.

The drive actuator 60 is biased toward the housing 42 and pawl 56, for example by a pair of torsion springs 118 that may be disposed about the ends of the third pin 110 and preloaded with a desired torque. Each spring 118 may be disposed within a cavity 120, as shown in FIGS. 3–4, that is provided on opposite sides of the front end of the drive actuator 60 between the link arms 86, 88 of the release actuator 58. One end of the spring 118 may be attached to the cap 122 and the other end of the spring may be attached to a radial slot 124 in the front end of the drive actuator 60. Each cap 122 may have a recess 126 that interlocks with a corresponding link arm 86, 88 so that the cap 122 does not rotate thereby maintaining the preloaded torque in the torsion springs 118. It is to be appreciated that other known biasing means may be used.

The drive actuator 60 may be provided with an aperture 116 primarily to reduce the weight of the lever. The drive actuator 60 may also have a curved and streamlined shape which conforms closely to the shape of the housing 42 and pawl 56, thereby reducing the overall profile of the ratchet buckle 32. The drive actuator may be formed from an aluminum alloy for strength and rigidity, although other materials may be used, such as a plastic material.

The operation of the drive actuator 60 to tighten the strap with the buckle is similar to Burton's Slap Ratchet and will be described with reference to FIGS. 5–6B. To tighten the strap, the user pivots the drive actuator 60 in the second direction $C_2$ about the third axis 106 until the leading ratchet tooth 114 engages a tooth 34 on the strap as shown in FIG. 6A. The user then pivots the drive actuator 60 about the third axis 106 while also pushing the ratchet teeth 112 firmly against the strap teeth 34 by pivoting the lever 83 about the second axis 80 in the second direction $B_2$ as shown in FIG. 6B. Rotating the drive actuator 60 in this manner ensures that each succeeding ratchet tooth 112 coacts with a corresponding strap tooth 34 to drive the strap through the housing. As the strap 30 is driven through the housing 42, the pawl 56 is continuously biased against the strap and coacts with the strap teeth 34 to prevent the strap from being inadvertently released during the ratcheting operation of the drive actuator 60. In this manner, the user can incrementally tighten the strap tension by pivoting the drive actuator 60 about the third axis 106 as many times as necessary. When the desired tension is achieved, the user releases the drive actuator which is then biased to its latched position by the drive actuator torsion springs 118.

Although the buckle 32 is preferably released from the strap 30 by pulling the release actuator using the caps 122, the strap may alternatively be released using the drive actuator 60 to actuate the release actuator 58. The user would partially pivot the drive actuator 60 in the second direction $C_2$, similar to the position as shown in FIG. 6A, as if to tighten the strap. The user would then pull the drive actuator 60 in an upward/rear direction E (FIG. 6C) which would pivot the release actuator 58, as described above with respect to the caps 122, to release the pawl 56 and the buckle from the strap.

As shown in FIGS. 1 and 5, the ratchet buckle 32 may be attached to a portion 130 of the adjustable ankle strap 24 of the binding 22 using a fastener 132, such as a rivet or the like. Preferably, only one end of the housing 42 is attached to the strap portion 130 so that the buckle may pivot about the fastener 132 to provide additional flexibility in the binding.

From the foregoing description, it will be appreciated that the ratchet buckle of the present invention provides a convenient and easily operated buckle that is particularly suitable for a soft boot snowboard binding which requires a user to release and secure the binding numerous times during a typical day of snowboarding. When the user wishes to secure a boot to a binding, the user steps into the binding and inserts the strap through buckle. Typically, the user may make coarse adjustments to the binding simply by pushing or pulling strap further in the buckle. The binding strap is then selectively tightened by incrementally feeding the strap through the buckle using the drive actuator in a ratcheting manner. It will be appreciated that as the strap is tightened, the amount of force necessary to increase the tension in the strap also increases which is easily overcome using the drive actuator. When the user wishes to release the buckle from the strap so that he or she can step out of the binding, the user simply pulls the release actuator using one continuous motion which releases the pawl from the strap and pulls the buckle along the strap to separate the buckle from the strap. The tightening and release operations can be easily accomplished by a user wearing gloves and other hand coverings.

Although the ratchet buckle has been described in connection with a snowboard binding, it is to be appreciated that the ratchet buckle of the present invention may also be used on other footwear, such as snowboard boots, ski boots, in-line skates and the like, to provide the wearer of such footwear the convenience and advantages of incrementally tightening and easily loosening the footwear. The ratchet buckle may also be used in conjunction with a strap for binding or lashing down loads, such as securing a load to a vehicle roof and the like. It should be understood that relative orientation adjectives have been utilized to simplify the present description and are not intended to limit the orientation of the buckle arrangement when mounted to a snowboard binding or other apparatus.

Having described a particular embodiment of the invention in detail, various modifications and improvements will readily occur to those skilled in the art. Such modifications and improvements are intended to be part of this disclosure and within the spirit and scope of the invention.

Accordingly, the foregoing description is by way of example only and the invention is defined by the following claims and their equivalents.

What is claimed is:

1. A ratchet buckle for adjusting a strap, the ratchet buckle comprising:

a housing that is adapted to slidably receive the strap, the housing having a front portion and a rear portion;

a pawl constructed and arranged to engage and prevent movement of the strap in a direction from the rear portion toward and through the front portion of the housing while allowing movement of the strap in a direction from the front portion toward and through the rear portion of the housing;

a drive actuator constructed and arranged to feed the strap through the housing from the front portion of the housing toward the rear portion of the housing; and a release actuator constructed and arranged to be actuated in a first direction to disengage the pawl from the strap, wherein continuously directed movement of the release actuator in the first direction causes withdrawal of the strap from and through the front portion of the housing.

2. The ratchet buckle recited in claim 1, wherein the pawl is pivotally mounted to the housing.

3. The ratchet buckle recited in claim 2, wherein the release actuator is pivotally mounted to the housing.

4. The ratchet buckle recited in claim 3, wherein the pawl is pivotally mounted about a first axis and the release actuator is pivotally mounted about a second axis that is spaced from the first axis.

5. The ratchet buckle to recited in claim 4, wherein the drive actuator is pivotally attached to the release actuator about a third axis that is spaced from the first and second axes.

6. The ratchet buckle recited in claim 5, in combination with a snowboard binding that includes a snowboard binding plate and one or more straps attached to the binding plate, the buckle being attached to at least one of the one or more straps.

7. The ratchet buckle recited in claim 3, wherein the drive actuator is pivotally attached to the release actuator.

8. The ratchet buckle recited in claim 7, wherein the release actuator includes a pair of link arms, one end of the link arms being pivotally attached to the housing and the other end of the link arms being pivotally attached to the drive actuator.

9. The ratchet buckle recited in claim 1, further comprising a stop that is constructed and arranged to limit movement of the release actuator.

10. The ratchet buckle recited in claim 9, wherein the stop is disposed on the release actuator.

11. The ratchet buckle recited in claim 10, wherein the stop engages the pawl when the pawl is disengaged from the strap.

12. The ratchet buckle recited in claim 1, wherein the release actuator pivots in a first direction and the pawl pivots in a second direction that is opposite the first direction to disengage the pawl from the strap.

13. The ratchet buckle recited in claim 12, wherein the drive actuator pivots in a second direction that is opposite the first direction of the release actuator to drive the strap through the housing.

14. The ratchet buckle recited in claim 1, wherein the pawl includes at least one pawl tooth that is adapted to engage the strap to prevent the strap from being withdrawn from the housing.

15. The ratchet buckle recited in claim 14, wherein the drive actuator includes at least one ratchet tooth that is adapted to engage and drive the strap through the housing to tighten the strap.

16. The ratchet buckle recited in claim 1, wherein the release actuator includes a release member that contacts and disengages the pawl from the strap.

17. The ratchet buckle recited in claim 16, wherein the release member includes a cam surface that contacts the pawl to disengage the pawl from the strap.

18. The ratchet buckle recited in claim 17, wherein the cam surface is arcuate.

19. The ratchet buckle recited in claim 18, wherein the release member includes a stop portion that contacts the pawl and limits movement of the release actuator when disengaging the pawl from the strap.

20. The ratchet buckle recited in claim 1, in combination with a snowboard binding that includes a snowboard binding plate and one or more straps attached to the binding plate the buckle being attached to at least one of the one or more straps.

21. The ratchet buckle recited in claim 1, wherein the first direction is toward the rear portion of the housing.

22. The ratchet buckle recited in claim 1, wherein the drive actuator is constructed and arranged to incrementally drive the strap through the housing in a ratcheting manner.

23. A ratchet buckle for adjusting a strap, the ratchet buckle comprising:

a housing that is adapted to slidably receive the strap therein;

a pawl pivotally mounted to the housing about a first axis, the pawl being constructed and arranged to engage and retain the strap;

a drive actuator pivotally mounted to the housing about a second axis and a third axis, the second axis being spaced from the first axis and the third axis being spaced from the second axis, the drive actuator being constructed and arranged to engage and feed the strap through the housing to tighten the strap; and a release actuator supported by the housing, the release actuator being constructed and arranged to disengage the pawl from the strap so that the strap can be released from the housing.

24. The ratchet buckle recited in claim 23, wherein the release actuator is pivotally mounted to the housing.

25. The ratchet buckle recited in claim 24, wherein the release actuator is mounted about the second axis.

26. The ratchet buckle recited in claim 23, wherein movement of the release actuator disengages the pawl from the strap and moves the housing along the strap to release the strap from the buckle.

27. The ratchet buckle recited in claim 1, in combination with a snowboard binding that includes a snowboard binding plate and one or more straps attached to the binding plate the buckle being attached to at least one of the one or more straps.

28. A ratchet buckle for adjusting a strap, the ratchet buckle comprising:

a housing for slidably receiving the strap the housing having a front portion and a rear portion;

means for engaging and preventing movement of the strap in a direction from the rear portion toward and through the front portion of the housing while allowing movement of the strap in a direction from the front portion toward and through the rear portion of the housing;

means for driving the strap in a direction from the front portion of the housing toward the rear portion of the housing; and means for disengaging and causing withdrawal of the strap from and through the front portion of the housing through one continuously directed motion.

* * * * *

UNITED STATES PATENT AND TRADEMARK OFFICE

CERTIFICATE OF CORRECTION

PATENT NO. : 5,745,959

DATED : May 5, 1998

INVENTOR(S) : David J. Dodge

It is certified that errors appear in the above-identified patent and that said Letters Patent are hereby corrected as shown below:

IN THE CLAIMS:
In claim 5, line 1, after "The ratchet buckle", delete "to".
In claim 20, line 3, after "the binding plate", insert --,--.
In claim 27, line 1, replace "claim 1" with --claim 23--.
In claim 27, line 3, after "the binding plate", insert --,--.

Signed and Sealed this

Fourteenth Day of July, 1998

Bruce Lehman

*Attest:*

BRUCE LEHMAN

*Attesting Officer*

*Commissioner of Patents and Trademarks*